United States Patent [19]

Güldner et al.

[11] Patent Number: 4,836,975

[45] Date of Patent: Jun. 6, 1989

[54] CONTAINER, IN PARTICULAR FOR A RADIOACTIVE SUBSTANCE

[75] Inventors: Ralf Güldner; Ingo Lasberg, both of Alzenau; Kurt Wittmann, Erlensee; Gerd Kindleben, Frankfurt, all of Fed. Rep. of Germany

[73] Assignee: Alkem GmbH, Hanau, Fed. Rep. of Germany

[21] Appl. No.: 118,753

[22] Filed: Nov. 5, 1987

[30] Foreign Application Priority Data

Nov. 13, 1986 [DE] Fed. Rep. of Germany ..... 3638702

[51] Int. Cl.[4] ..... G21C 19/40; G21F 5/00; B65D 85/00

[52] U.S. Cl. ..... 376/272; 250/507.1; 220/23.2; 137/263

[58] Field of Search ..... 376/272; 250/507.1, 250/506.1; 220/23.2, 855; 252/633, 631; 137/263, 266, 264

[56] References Cited

U.S. PATENT DOCUMENTS

| | | | |
|---|---|---|---|
| 3,175,087 | 3/1965 | Aupetit et al. | 250/507.1 |
| 3,573,462 | 4/1971 | Wilkins et al. | 250/108 |
| 3,845,315 | 10/1974 | Blum | 376/272 |
| 4,152,585 | 5/1979 | Myers | 250/507.1 |
| 4,672,213 | 6/1987 | Stoll et al. | 376/272 |
| 4,738,799 | 4/1988 | Troy | 376/272 |
| 4,747,512 | 5/1988 | Lo | 250/506.1 |

FOREIGN PATENT DOCUMENTS

| | | |
|---|---|---|
| 0143398 | 7/1985 | European Pat. Off. . |
| 1097584 | 1/1961 | Fed. Rep. of Germany . |
| 2300620 | 7/1974 | Fed. Rep. of Germany . |
| 3028040 | 3/1982 | Fed. Rep. of Germany . |
| 3343166 | 6/1985 | Fed. Rep. of Germany . |

*Primary Examiner*—Deborah L. Kyle
*Assistant Examiner*—Daniel Wasil
*Attorney, Agent, or Firm*—Herbert L. Lerner; Laurence A. Greenberg

[57] ABSTRACT

A container for a liquid radioactive and/or fissionable substance includes an outer container. An inner container is disposed in said outer container for receiving the substance. The inner container includes a primary container and a separate, closed secondary container having upper and lower ends. The primary container has an upper end protruding beyond said upper end of said secondary container and a lower end protruding beyond said lower end of said secondary container in longitudinal direction. A first connecting tube leads continuously downward in a direction from said lower end of said secondary container toward said lower end of said primary container. A second connecting tube leads continuously upward from said upper end of said secondary container in a direction toward said upper end of said primary container. The outer container has a fill chamber disposed therein for filling with heat-conducting filler.

11 Claims, 2 Drawing Sheets

CONTAINER, IN PARTICULAR FOR A RADIOACTIVE SUBSTANCE

The invention relates to a container, in particular for a liquid radioactive and/or fissionable substance, including an inner container for receiving the substance and an outer container in which the inner container is disposed.

A container of this type is known from German Published, Non-Prosecuted Application DE-OS No. 33 43 166, corresponding to European Published Application No. 0 143 398. The inner container thereof is formed in one piece. The inner container includes a bar in the form of a steel tube filled with boron carbide, which absorbs neutrons in order to prevent a critical configuration of fissionable radioactive substances.

However, the diameter of the inner container must not exceed a predetermined threshold value if a critical configuration is to be reliably avoided, since the bars may gradually lose their effectiveness to a point where the inner container no longer contains any neutron-absorbing bars. Although the height of the inner container can be selected to be very great, if a large capacity of the inner container is desired, a slender inner container that is very high nevertheless provides a container that is awkward to handle. In particular, it is difficult to fill and empty such an inner container.

It is accordingly an object of the invention to provide a container, in particular for a radioactive substance, which overcomes the hereinafore-mentioned disadvantages of the heretofore-known devices of this general type and which has a more favorable ratio of diameter to height.

With the foregoing and other objects in view there is provided, in accordance with the invention, a container for a liquid radioactive and/or fissionable substance, comprising an outer container, an inner container disposed in said outer container for receiving the substance, said inner container including a primary container and a separate, closed secondary container having upper and lower ends, said primary container having an upper end protruding beyond said upper end of said secondary container and a lower end protruding beyond said lower end of said secondary container in longitudinal direction, a first connecting tube leading continuously downward in a direction from said lower end of said secondary container toward said lower end of said primary container, and a second connecting tube leading continuously upward from said upper end of said secondary container in a direction toward said upper end of said primary container, said outer container having a fill chamber disposed therein for filling with heat-conducting filler.

By subdividing the inner container into a primary container and a secondary container, a radioactive liquid substance contained in the two containers is kept spatially separated, so that a physical neutron decoupling is effected.

The decoupling can be improved even further by suitably selecting the filler for the fill chamber. In accordance with another feature of the invention, there is provided a liquid filler disposed in said fill chamber.

A suitable filler is natural water, for instance, which is a moderator substance but which also has a large cross section for trapping thermal neutrons and furthermore has a shock-absorbing action and is good for conducting heat out of the inner container to the outside.

The physical neutron decoupling can be improved even further by manufacturing the primary container and/or the secondary container from neutron-absorbing material, and/or by providing that the filler for the fill chamber of the outer container includes a substance that absorbs neutrons to an increased extent.

In accordance with a further feature of the invention, the outer container has an inner surface, and there is provided a spring-loaded piston attached to said fill chamber having an effective surface area forming part of said inner surface of said outer container. This feature assures that a filler in the form of a liquid such as water is kept at overpressure in the fill chamber, so that in the event of leakage in the primary or secondary container, the filler is forced into the primary or secondary container, and it is only with additional difficulty that a radioactive liquid substance could possibly escape from the primary or secondary container.

In accordance with an added feature of the invention, there are provided means for supplying said liquid filler with an overpressure.

In accordance with an additional feature of the invention, the outer container has an inner surface, and there are provided shock absorbers or rigid struts retaining said inner container on said inner surface of said outer container.

In accordance with yet another feature of the invention, there are provided support struts supporting said secondary container on said primary container.

In accordance with yet a further feature of the invention, the primary container is centrally disposed in an imaginary regular polygon, preferably a hexagon, at a cross section of said outer container, and said secondary container is disposed in a corner of said polygon.

In accordance with a concomitant feature of the invention, there is provided an overpressure valve or bursting disk attached to said outer container and leading to the outside from said fill chamber.

Other features which are considered as characteristic for the invention are set forth in the appended claims.

Although the invention is illustrated and described herein as embodied in a container, in particular for a radioactive substance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
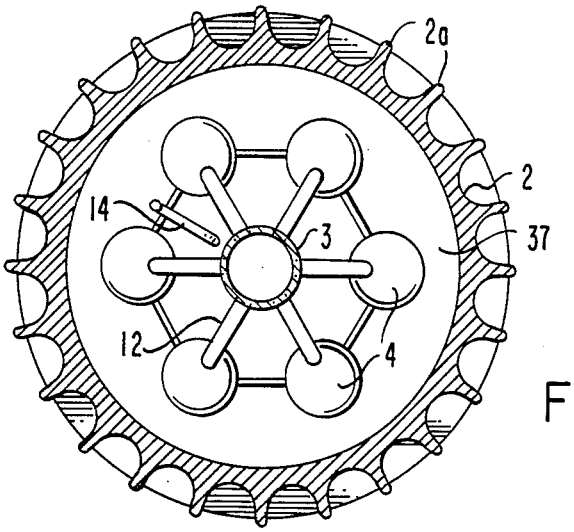
FIG. 2 is a cross-sectional view of the container taken along the dot-dash line II—II of FIG. 1 in the direction of the arrows.
Figure 1:
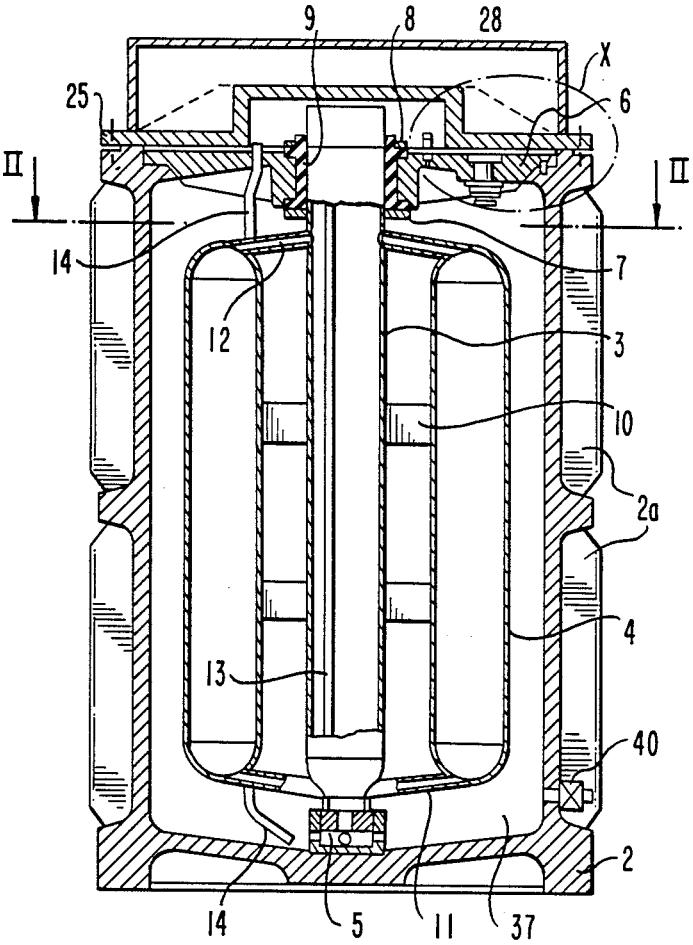
FIG. 1 is a diagrammatic, partly broken-away, longitudinal-sectional view of a container according to the invention.

Referring now to the figures of the drawings in detail and first, particularly, to FIGS. 1 and 2 thereof, there is seen a container including a hollow-cylindrical outer container 2, which is a cast part having cooling ribs 2*a* on the outside of the shell or jacket thereof. Inside the outer container 2 is an inner container having one hollow-cylindrical, elongated primary container 3 and six elongated, hollow-cylindrical secondary containers 4.

The longitudinal axes of the primary container 3 and the secondary containers 4 are parallel to one another, and the primary container 3 is coaxial with and attached to the outer container 2.

The lower end of the primary container 3 is retained at the center of the inner surface of the bottom of the outer container 2 with a shock absorber 5. The upper end of the primary container 3 is extended through the center of a cap 6 which is tightly screwed to the upper end of the outer container 2. The primary container 3 has an outer flange 7 on the inside of the cap 6, while a grooved nut 8 is seated on the primary container 3 on the outside of the cap 6. A sheath 9 of an elastomer such as natural rubber, which has flanges on both ends, is also seated on the primary container 3 inside the cap. One flange of the sheath 9 rests on the outer flange 7 of the primary container 3, while the grooved nut 8 rests on the other flange. The nut 8 firmly clamps the primary container 3 to the cap 6 through the sheath 9 with the outer flanges thereof. The sheath 9 with the outer flanges thereof, thus serves as a further shock absorber.

As seen in the cross section of the outer container 2 in FIG. 2, the primary container 3 of the inner container is disposed centrally in a regular hexagon in the outer container 2, with the six secondary containers 4 of the inner container each being disposed in a respective corner of the hexagon. The six secondary containers 4 are separated from the primary container 3 and are closed off at both ends thereof. The upper end of the primary container 3 protrudes beyond the upper ends of the secondary containers 4 and the lower end of the primary container 3 protrudes beyond the lower ends of the secondary containers 4. The secondary containers 4 are supported on the primary container 3 with support struts 10. A first connecting tube 11 which also leads from the lower end of each of the six secondary containers 4 to the primary container, continuously declines in the direction toward the lower end of the primary container 3. A second connecting tube 12 leads from the upper end of each of the secondary containers 4 to the primary container 3, with a continuous upward inclination in the direction of the upper end of the primary container 3.

A plunger tube 13 leads from the upper end of the primary container 3, for filling the inner container with, or emptying the inner container of, a liquid radioactive substance. An air evacuation and ventilation tube at the upper end of the primary container 3 is not visible in the drawing.

Figure 3:
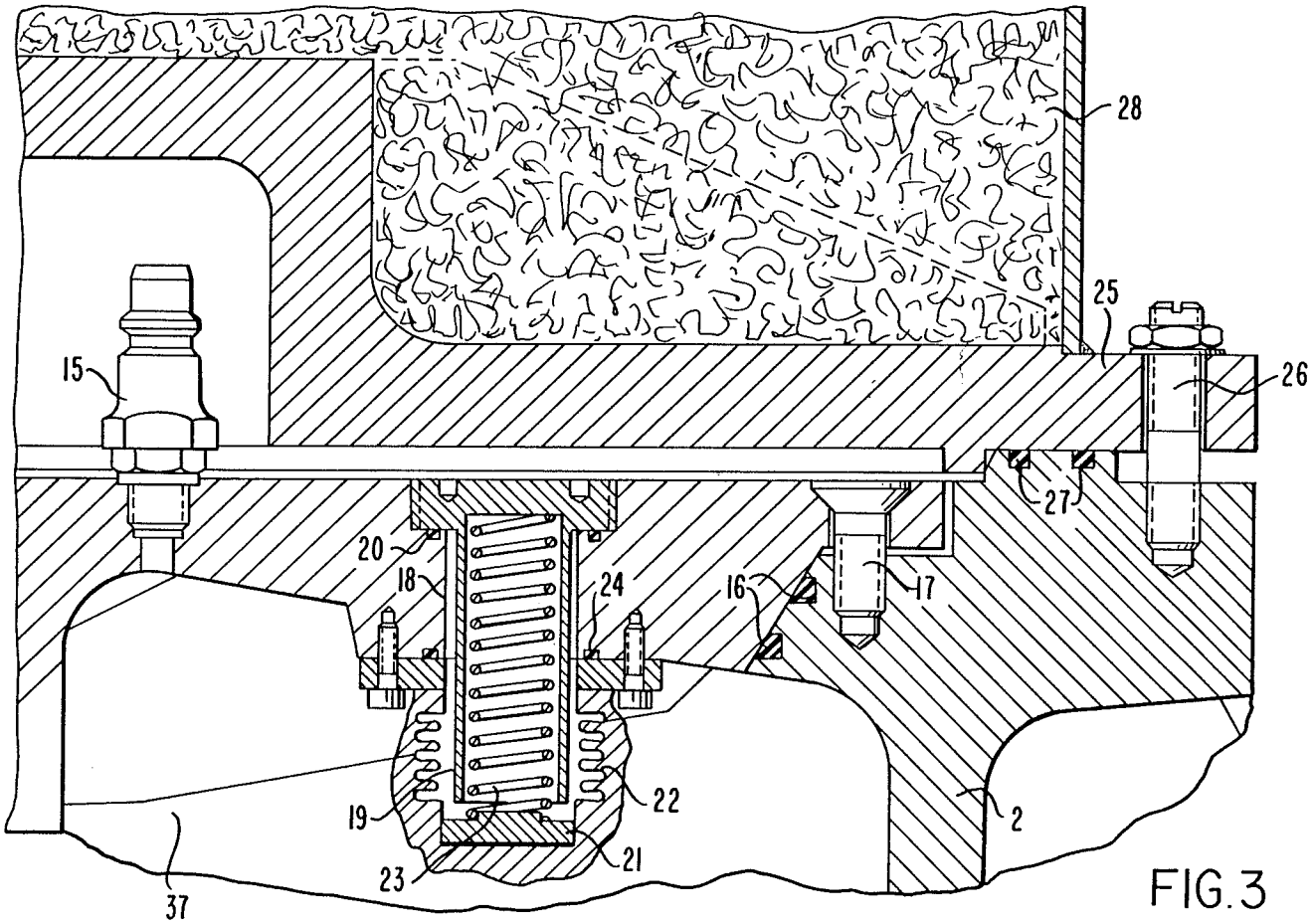
FIG. 3 is an enlarged, fragmentary view of the portion X in FIG. 1.

Another plunger tube 14 leads from the cap 6 to the bottom of the outer container 2, for filling and evacuating a fill chamber 37 in the outer container 2. As is clearly shown in FIG. 3, an air evacuation and ventilation connector pipe 15 which is also disposed in the cap 6, automatically closes whenever a coupling piece of a non-illustrated hose line is removed from the pipe 15. Sealing rings 16 are also seen in FIG. 3 between the cap 6 and the outer container 2. A screw 17 which firmly screws the cap 6 to the outer container 2 is also shown.

A hollow cylinder 19 that is open on the inside of the cap 6 is disposed in a duct 18 in the cap 6. The sealed bottom of the hollow cylinder 19 is screwed firmly and sealed off with a sealing ring 20. Located inside the hollow cylinder 19 is a coaxial helical spring 23, having one end supported on the bottom of the hollow cylinder 19 and another end supported on a piston 21, which is firmly screwed to the inside of the cap 6 by a metal folding bellows 22 that encompasses the open end of the hollow cylinder 19. The piston 21 is sealed with a sealing ring 24. The effective surface area of the piston 21 formed of the outer surface thereof, is thus part of the inner surface of the outer container 2.

Natural water is pumped through the plunger tube 14 into the fill chamber 37 of the outer container 2 as a liquid filler and a coupling piece of the non-illustrated hose line is uncoupled from the air evacuation and ventilation connector 15 whenever water emerges through the air evacuation and ventilation connector 15. The air evacuation and ventilation connector 15 closes automatically as a result and the water in the fill chamber 37 of the outer container 2 is given an overpressure by further pumping at the plunger tube 14, so that the piston 21 compresses the helical spring 23, without the piston 21 coming to rest on the hollow cylinder 19. A non-illustrated hose for supplying water is then also uncoupled from the plunger tube 14, which has a non-illustrated fill connector in the cap 6 that also closes automatically whenever the coupler piece of the hose is removed therefrom. The pressure subsequently exerted by the compressed helical spring 23 upon the water in the fill chamber of the outer container 2 through the effective surface area of the piston 21, maintains the overpressure in the fill chamber.

The outer container 2 is also provided with a protective cap 25, which is firmly screwed on the outer container 2 over the cap 6 with screws 26 and is sealed off with sealing rings 27 set in place in the outer container 2. The protective cap 25 receives the upper end of the primary container 3, the air evacuation and ventilation connector 15 and the non-illustrated filling connector of the plunger tube 14. The outer surface of the cap 25 is covered with polyurethane foam 28.

An overpressure valve or a bursting disk 40 which leads from the fill chamber 37 to the outside is also advantageously attached to the outer container 2. In case of fire, the overpressure valve 40 yields to the excessive overpressure arising in the fill chamber 37 and steam escapes to the outside. In order to produce the steam, decay heat is drawn from the radioactive liquid substance in the inner container.

The foregoing is a description corresponding in substance to German Application No. P 36 38 702.9, dated Nov. 13, 1986, the International priority of which is being claimed for the instant application, and which is hereby made part of this application. Any material discrepancies between the foregoing specification and the aforementioned corresponding German application are to be resolved in favor of the latter.

We claim:

1. Container for a liquid substance, comprising an outer container, an inner container disposed in said outer container for receiving the substance, said inner container including a primary container and a separate, closed secondary container having upper and lower ends, said primary container having an upper end protruding beyond said upper end of said secondary container and a lower end protruding beyond said lower end of said secondary container in longitudinal direction, a first connecting tube leading continuously downward in a direction from said lower end of said secondary container toward said lower end of said primary container, and a second connecting tube leading continuously upward from said upper end of said secondary container in a direction toward said upper end of said primary container, said outer container having a fill chamber disposed therein for filling with heat-conducting filler.

2. Container according to claim 1, wherein said outer container has an inner surface, and including a spring-loaded piston attached to said fill chamber having an effective surface area forming part of said inner surface of said outer container.

3. Container according to claim 2, including a liquid filler disposed in said fill chamber.

4. Container according to claim 3, including means for supplying said liquid filler with an overpressure.

5. Container according to claim 1, wherein said outer container has an inner surface, and including shock absorbers retaining said inner container on said inner surface of said outer container.

6. Container according to claim 1, wherein said outer container has an inner surface, and including rigid struts retaining said inner container on said inner surface of said outer container.

7. Container according to claim 1, including support struts supporting said secondary container on said primary container.

8. Container according to claim 1, wherein said primary container is centrally disposed in an imaginary regular polygon at a cross section of said outer container, and said secondary container is disposed in a corner of said polygon.

9. Container according to claim 1, wherein said primary container is centrally disposed in an imaginary hexagon at a cross section of said outer container, and said secondary container is disposed in a corner of said hexagon.

10. Container according to claim 1, including an overpressure valve attached to said outer container and leading to the outside from said fill chamber.

11. Container according to claim 1, including a bursting disk attached to said outer container and leading to the outside from said fill chamber.

* * * * *